US008602800B2

(12) United States Patent
Borgstrom et al.

(10) Patent No.: US 8,602,800 B2
(45) Date of Patent: Dec. 10, 2013

(54) ELECTRICAL CONNECTOR HAVING ALIGNMENT MECHANISM

(75) Inventors: Alan D. Borgstrom, Hackettstown, NJ (US); James Cole, Oxford, NJ (US); Larry N. Siebens, Asbury, NJ (US)

(73) Assignee: Thomas & Betts International, Inc., Wilmington, DE (US)

( * ) Notice: Subject to any disclaimer, the term of this patent is extended or adjusted under 35 U.S.C. 154(b) by 84 days.

(21) Appl. No.: 13/081,767

(22) Filed: Apr. 7, 2011

(65) Prior Publication Data

US 2011/0256746 A1 Oct. 20, 2011

Related U.S. Application Data

(60) Provisional application No. 61/325,848, filed on Apr. 20, 2010.

(51) Int. Cl.
*H01R 13/53* (2006.01)

(52) U.S. Cl.
USPC ..... 439/181; 439/801

(58) Field of Classification Search
USPC ..... 439/181–187, 801, 813, 921
See application file for complete search history.

(56) References Cited

U.S. PATENT DOCUMENTS

| | | | | |
|---|---|---|---|---|
| 3,576,493 | A | 4/1971 | Tachick | |
| 4,722,694 | A * | 2/1988 | Makal et al. | 439/181 |
| 4,776,089 | A * | 10/1988 | Schoenwetter et al. | 29/876 |
| 4,799,895 | A * | 1/1989 | Borgstrom | 439/183 |
| 4,857,021 | A * | 8/1989 | Boliver et al. | 439/801 |
| 5,562,485 | A | 10/1996 | Hoyte et al. | |
| 5,795,180 | A | 8/1998 | Siebens | |
| 6,491,548 | B2 | 12/2002 | Stepniak et al. | |
| 6,504,103 | B1 | 1/2003 | Meyer et al. | |
| 6,520,795 | B1 * | 2/2003 | Jazowski | 439/475 |
| 6,790,063 | B2 | 9/2004 | Jazowski et al. | |
| 6,830,475 | B2 | 12/2004 | Jazowski et al. | |
| 6,843,685 | B1 | 1/2005 | Borgstrom et al. | |
| 6,984,791 | B1 | 1/2006 | Meyer et al. | |
| 7,044,769 | B2 | 5/2006 | Zhao et al. | |
| 7,182,647 | B2 | 2/2007 | Muench et al. | |
| 7,381,103 | B2 * | 6/2008 | Luzzi | 439/801 |
| 7,431,599 | B2 * | 10/2008 | Luzzi | 439/181 |
| 7,501,598 | B2 | 3/2009 | Stepniak et al. | |
| 7,517,260 | B2 | 4/2009 | Luzzi | |
| 7,579,571 | B2 | 8/2009 | Siebens et al. | |
| 7,591,693 | B2 | 9/2009 | Hughes | |
| 7,938,682 | B2 * | 5/2011 | Su | 439/587 |
| 8,018,707 | B2 * | 9/2011 | Yaworski et al. | 361/127 |
| 8,043,102 | B2 * | 10/2011 | Lu et al. | 439/181 |
| 2008/0166913 | A1 | 7/2008 | Siebens et al. | |
| 2008/0311779 | A1 | 12/2008 | Brassell et al. | |
| 2009/0215307 | A1 | 8/2009 | Hughes | |
| 2010/0279543 | A1 * | 11/2010 | Nguyen et al. | 439/521 |

* cited by examiner

*Primary Examiner* — Thanh Tam Le
(74) *Attorney, Agent, or Firm* — Snyder, Clark, Lesch & Chung, LLP

(57) ABSTRACT

An electrical connector assembly may include a connector body having a conductor receiving end and first and second connector ends formed substantially perpendicularly to an axial direction of the conductor receiving end. The connector body includes a first axial bore that communicates with each of a second axial bore and a third axial bore in the first and second connector ends, respectively. The electrical connector assembly may include a conductor spade assembly received in the first axial bore, wherein the conductor spade assembly includes a spade portion extending between the second axial bore and the third axial bore. A removeable contact may be received within the second axial bore to conductively engage the spade portion of the conductor spade assembly.

18 Claims, 9 Drawing Sheets

ELECTRICAL CONNECTOR HAVING ALIGNMENT MECHANISM

CROSS-REFERENCE TO RELATED APPLICATION

This application claims priority under 35. U.S.C. §119, based on U.S. Provisional Patent Application No. 61/325,848 filed Apr. 20, 2010, the disclosure of which is hereby incorporated by reference herein.

BACKGROUND OF THE INVENTION

The present invention relates to electrical cable connectors, such as loadbreak connectors and deadbreak connectors. More particularly, aspects described herein relate to an electrical cable connector, such as a power cable elbow or T-connector connected to electrical switchgear assembly.

Loadbreak connectors used in conjunction with 15 and 25 KV switchgear generally include a power cable elbow connector having one end adapted for receiving a power cable and another end adapted for receiving a loadbreak bushing insert or other switchgear device. The end adapted for receiving the bushing insert generally includes an elbow cuff for providing an interference fit with a molded flange on the bushing insert.

In some implementations, the elbow connector may include a second opening formed opposite to the bushing insert opening for providing conductive access to the power cable by other devices. Typically, the second opening is provided with an elbow cuff for providing an interference fit with a molded flange on the attached device, such as a loadbreak reducing bushing.

DETAILED DESCRIPTION OF THE PREFERRED EMBODIMENTS

The following detailed description refers to the accompanying drawings. The same reference numbers in different drawings may identify the same or similar elements.

Figure 1:
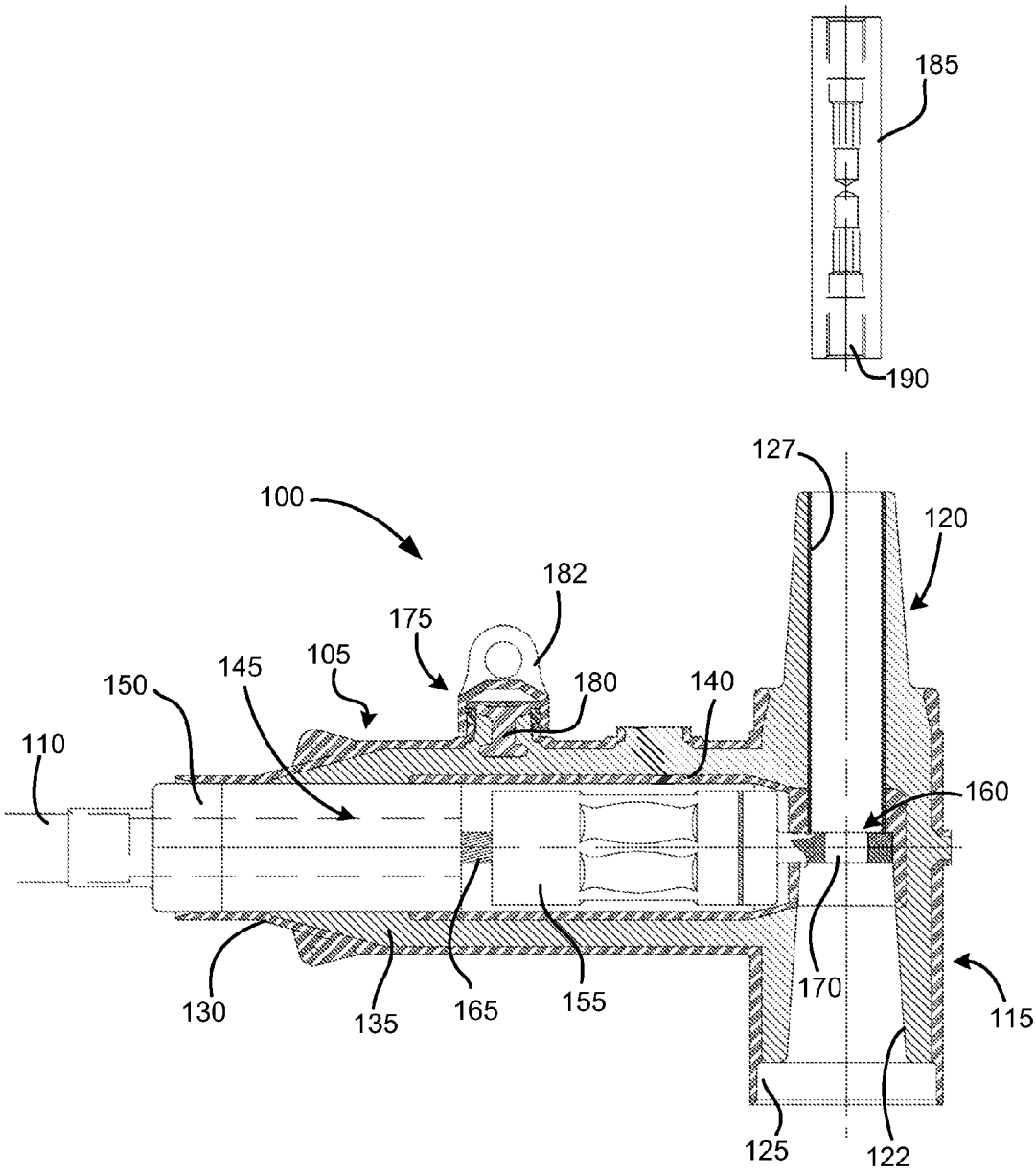
FIG. 1 is a schematic cross-sectional diagram illustrating an electrical connector consistent with implementations described herein.

FIG. 1 is a schematic cross-sectional diagram illustrating a combined power cable elbow connector 100 in an unassembled configuration consistent with implementations described herein. As shown in FIG. 1, combined power cable elbow connector 100 may include a conductor receiving end 105 for receiving a power cable 110 therein, a first T end 115 that includes an opening for receiving a deadbreak transformer bushing (transformer bushing 405 in FIG. 4) or other high or medium voltage terminal, an insulating plug, etc., and a reducing T end 120 that includes an opening for receiving a second elbow or other device, such as a loadbreak device (not shown). Combined power cable elbow connector 100 may be termed "combined" because it includes a power cable elbow connector combined with a loadbreak and/or deadbreak reducing or other interface end 120.

As shown in FIG. 1, first T end 115 may include a bushing receiving portion 122 and a flange or elbow cuff 125. Bushing receiving portion 122 may include substantially conical sidewalls configured to receive mating sidewalls of an attached bushing or other device. Flange or elbow cuff 125 may surround the open receiving end of first T end 115 to provide a seating surface for sealingly receiving an attached bushing or other device (see FIG. 4).

Consistent with implementations described herein, reducing T end 120 may include a contact receiving portion 127. As described in detail below, contact receiving portion 127 may include a substantially cylindrical bore for receiving a contact assembly therein. As shown in FIG. 1, contact receiving portion 127 may be axially aligned with bushing receiving portion 122.

Conductor receiving end 105 may extend substantially axially from connector 100 and may include a bore extending therethrough. First T end 115 and reducing T end 120 may project substantially perpendicularly from conductor receiving end 105, as illustrated in FIGS. 1-4.

In some implementations, combined power cable elbow connector 100 may include a semi-conductive outer shield 130 formed from, for example, a semi-conductive variant of a peroxide-cured synthetic rubber, commonly referred to as EPDM (ethylene-propylene-dienemonomer). Within shield 130, combined power cable elbow connector 100 may include an insulative inner housing 135, typically molded from an insulative rubber or epoxy material. Within insulative inner housing 135, combined power cable elbow connector 100 may include a conductive or semi-conductive insert 140 that surrounds the connection portion of power cable 110.

Figure 2:
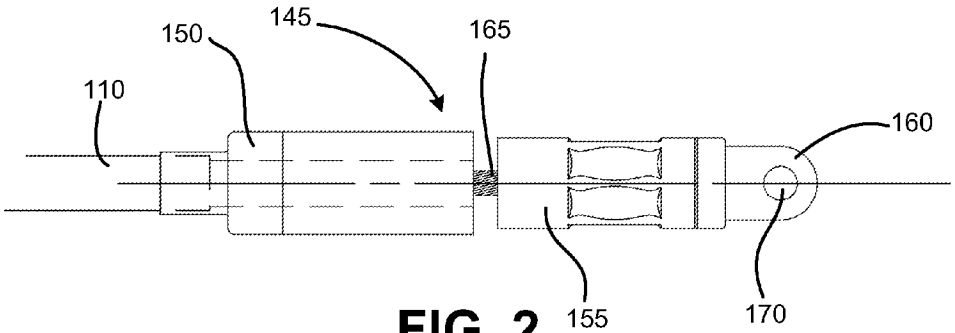
FIG. 2 is a top view of the spade connector of FIG. 1

Conductor receiving end 105 of combined power cable elbow connector 100 may be configured to receive power cable 110 therein. As described below with respect to FIGS. 2 and 3A-3B, a forward end of power cable 110 may be prepared by connecting power cable 110 to a conductor spade assembly 145. FIG. 2 illustrates a top view of conductor spade assembly 145. As illustrated in FIGS. 1 and 2, conductor spade assembly 145 may include a modular configuration. More specifically, conductor spade assembly 145 may include a rearward sealing portion 150, a crimp connector portion 155, and a spade portion 160.

Rearward sealing portion 150 may include an insulative material surrounding a portion of power cable 110 about an opening of conductor receiving end 105. When conductor spade assembly 145 is positioned within connector 100, rearward sealing portion 150 may seal an opening of conductor receiving end 105 about power cable 110.

Crimp connector portion 155 may include a substantially cylindrical assembly configured to receive a center conductor 165 of power cable 110 therein. Upon insertion of center conductor 165 therein, crimp connector portion 155 may be crimped onto power center conductor 165 prior to insertion of cable 110 into conductor receiving end 105.

Spade portion 160 may be conductively coupled to crimp connector portion 155 and may extend axially therefrom. As shown in FIG. 1, upon insertion of spade assembly 145 into connector 100, spade portion 160 may project into a space between first T end 115 and reducing T end 120. As shown in FIG. 2, spade portion 160 may include a perpendicular bore 170 extending from first T end 115 to reducing T end 120. As described below, once spade assembly 145 is properly seated within connector 100, bore 170 may allow a stud or other element associated with first T end 115 to conductively engage spade assembly 145 and/or a device connected to reducing T end 120.

In one exemplary implementation, combined power cable elbow connector 100 may include a voltage detection test point assembly 175 for sensing a voltage in connector 100. Voltage detection test point assembly 175 may be configured to allow an external voltage detection device, to detect and/or measure a voltage associated with connector 100.

For example, as illustrated in FIG. 1, voltage detection test point assembly 175 may include a test point terminal 180 embedded in a portion of insulative inner housing 135 and extending through an opening within outer shield 130. In one exemplary embodiment, test point terminal 180 may be formed of a conductive metal or other conductive material. In this manner, test point terminal 180 may be capacitively coupled to the electrical conductor elements (e.g., power cable 110) within the connector 100.

A test point cap 182 may sealingly engage a portion of test point terminal 180 and outer shield 130. In one implementation, test point cap 182 may be formed of a semi-conductive material, such as EPDM. When test point terminal 180 is not being accessed, test point cap 182 may be mounted on test point assembly 175. Because test point cap 182 is formed of a conductive or semi-conductive material, test point cap 182 may ground test point terminal 180 when in position.

Consistent with implementations described herein, connector 100 may include a contact assembly 185 for insertion within contact receiving portion 127 of reducing T end 120. In some implementations, contact assembly may be formed of a conductive material, such as copper or aluminum. Configuration of power elbow connector 100 to include reducing T end 120 may facilitate connection of a second power elbow connector to connector 100 via contact assembly 185 without requiring an intermediate reducing plug. Known reducing plugs may include conductive contact assemblies enclosed therein. However, incorporation of such an enclosed contact assembly into reducing T end 120 may prevent or substantially impair visual alignment during insertion of conductor spade assembly 145 into power elbow connector 100.

Figure 3A:
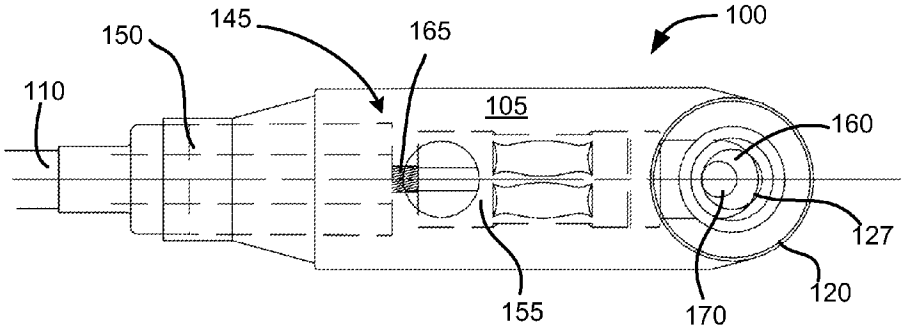
FIG. 3A is top view of the electrical connector of FIG. 1 in a misaligned configuration.
Figure 3B:
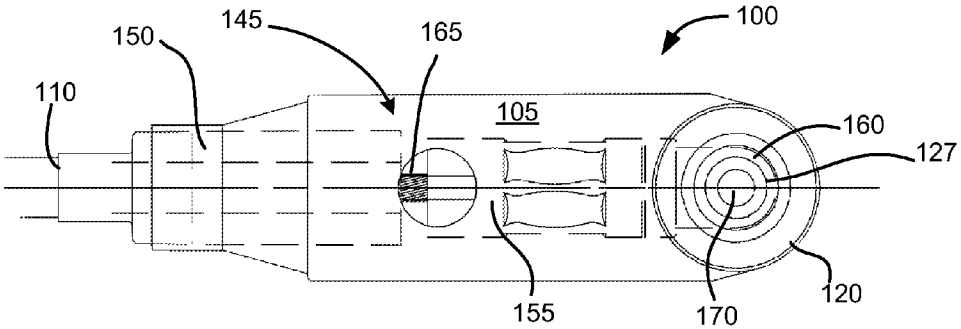
FIG. 3B is top view of the electrical connector of FIG. 1 in an aligned configuration.

By providing contact assembly 185 initially removed from reducing T end 120, a technician or installer may be provided with visual access to spade portion 160 of conductor spade assembly 145 during assembly of connector 100. FIG. 3A is a top view of power elbow connector 100 in a misaligned configuration. As shown in FIG. 3A, during initial assembly, spade portion 160 may be inserted into connector 100 such that bore 170 in spade portion 160 is not completely aligned (e.g., not concentrically aligned) with contact receiving portion 127 in reducing T end 120. Because reducing T end 120 does not initially include contact assembly 185, the installer may visually identify the misalignment and may fully insert spade portion 160 into connector 100, as shown in FIG. 3B. When fully inserted, bore 170 in spade portion 160 may be concentrically aligned with contact receiving portion 127 in reducing T end 120.

Figure 4:
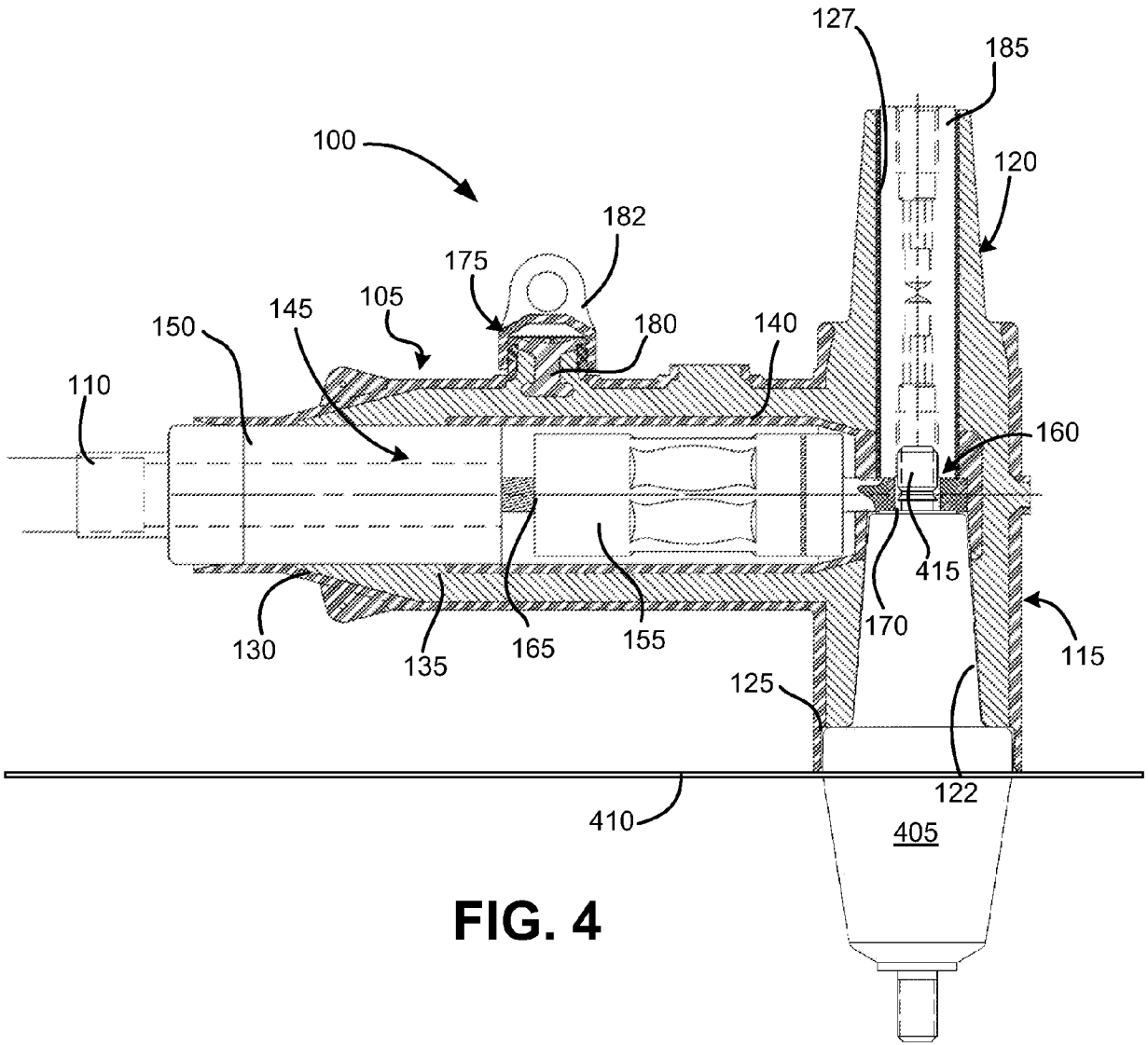
FIG. 4 is a schematic cross-sectional diagram of the electrical connector of FIG. 1 in an assembled configuration.

FIG. 4 is a schematic cross-sectional diagram of electrical connector 100 in an assembled configuration. As shown, a deadbreak bushing 405 may be mounted (e.g., welded, etc.) to an electrical switchgear, such as transformer housing 410 (a portion of which is shown in FIG. 4). Following full insertion of spade portion 160 into connector 100 (as visually confirmed through contact receiving portion 127), bushing receiving portion 122 in first T end 115 may be positioned onto bushing 405 such that a stud portion 415 of bushing 405 is received within bore 170 in spade portion 160.

Once power elbow connector 100 has been placed on bushing 405 (with stud 415 extending through bore 170), contact assembly 185 may be inserted into contact receiving portion 127 of reducing T end 120. In one implementation, contact assembly 185 may include a stud receiving portion 190 (FIG. 1) for conductively engaging stud 415 in bushing 405. For example, an inside diameter of stud receiving portion 190 may be sized slightly smaller than an outside diameter of stud 415. In other implementations (not shown), stud 415 and stud receiving portion 190 may include correspondingly threaded surfaces for engaging one another and retaining connector 100 to bushing 405.

Figure 5:
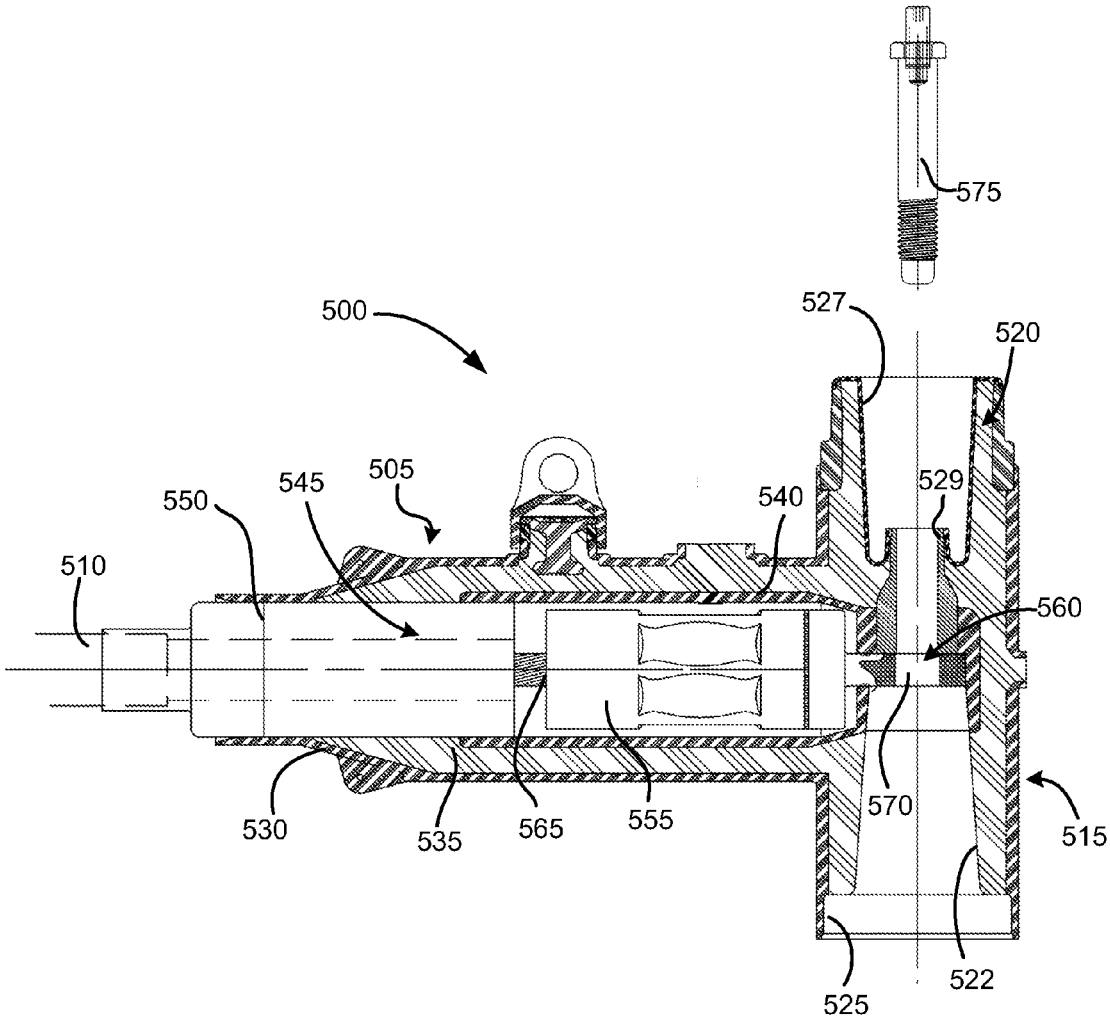
FIG. 5 is a schematic cross-sectional diagram illustrating an electrical connector consistent with another implementation described herein.

FIG. 5 is a schematic cross-sectional diagram illustrating another implementation of combined power cable elbow connector 500 in an unassembled configuration consistent with implementations described herein. Similar to combined power cable elbow connector 100 shown in FIGS. 1-4, combined power cable elbow connector 500 may include a conductor receiving end 505 for receiving a power cable 510 therein, and a first T end 515 that includes an opening for receiving a deadbreak transformer bushing (transformer bushing 705 in FIG. 7) or other high or medium voltage terminal, an insulating plug, etc. In addition, combined power cable elbow connector 500 may include a bushing well interface T end 520 that includes an opening for receiving a bushing or other similar device interface (not shown).

As shown in FIG. 5, first T end 515 may include a bushing receiving portion 522 and a flange or elbow cuff 525. Bushing receiving portion 522 may include substantially conical sidewalls configured to receive mating sidewalls of an attached bushing or other device. Flange or elbow cuff 525 may surround the open receiving end of first T end 515 to provide a seating surface for sealingly receiving an attached bushing or other device (see FIG. 7).

Consistent with implementations described herein, bushing well interface T end 520 may include a bushing receiving portion 527 and a stud receiving portion 529. Bushing receiving portion 527 may include substantially conical sidewalls for engaging exterior surfaces of a received bushing. As described in detail below, stud receiving portion 529 may include a substantially cylindrical bore for receiving a conductive stud therein. As shown in FIG. 5, stud receiving portion 529 may be axially aligned with bushing receiving portion 522 in first T end 515.

Figure 6A:
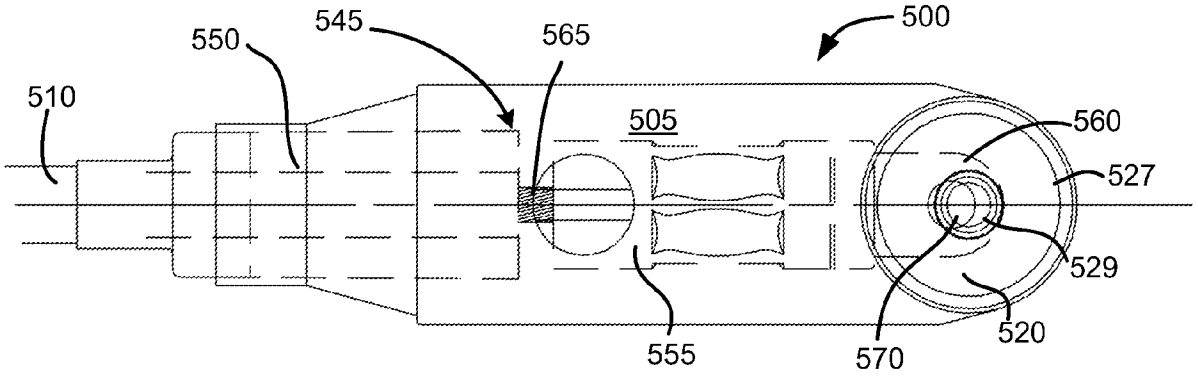
FIG. 6A is top view of the electrical connector of FIG. 5 in a misaligned configuration.
Figure 6B:
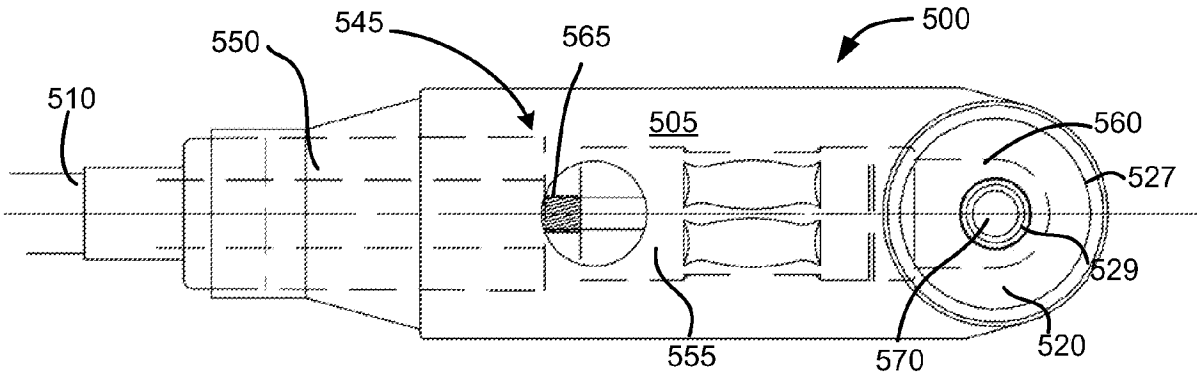
FIG. 6B is top view of the electrical connector of FIG. 5 in an aligned configuration.
Figure 7:
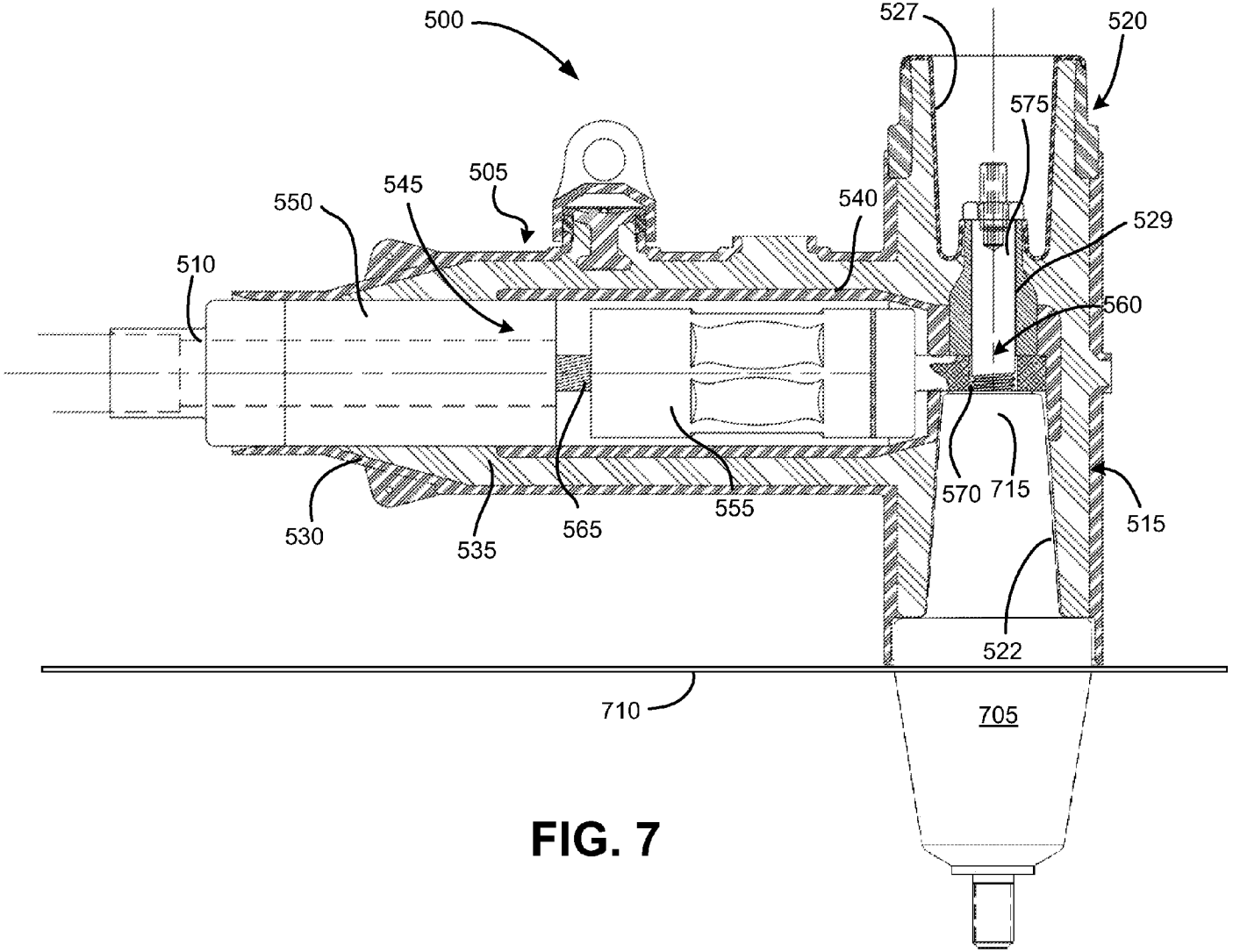
FIG. 7 is a schematic cross-sectional diagram of the electrical connector of FIG. 5 in an assembled configuration.

Similar to conductor receiving end 105 of connector 100, conductor receiving end 505 may extend substantially axially from connector 500 and may include a bore extending therethrough. First T end 515 and bushing well interface T end 520 may project substantially perpendicularly from conductor receiving end 505, as illustrated in FIGS. 5-7.

In some implementations, combined power cable elbow connector 500 may include a semi-conductive outer shield 530 formed from, for example, a semi-conductive variant of a peroxide-cured synthetic rubber, such as EPDM. Within shield 530, combined power cable elbow connector 500 may include an insulative inner housing 535, typically molded from an insulative rubber or epoxy material. Within insulative inner housing 535, combined power cable elbow connector 500 may include a conductive or semi-conductive insert 540 that surrounds the connection portion of power cable 510.

Conductor receiving end 505 of combined power cable elbow connector 500 may be configured to receive power cable 510 therein. As described below with respect to FIGS. 6A-6B, a forward end of power cable 510 may be prepared by connecting power cable 510 to a conductor spade assembly 545. As illustrated in FIGS. 5-7, conductor spade assembly 545 may include a modular configuration. More specifically, conductor spade assembly 545 may include a rearward sealing portion 550, a crimp connector portion 555, and a spade portion 560.

Rearward sealing portion 550 may include an insulative material surrounding a portion of power cable 510 about an opening of conductor receiving end 505. When conductor spade assembly 545 is positioned within connector 500, rearward sealing portion 550 may seal an opening of conductor receiving end 505 about power cable 510.

Crimp connector portion 555 may include a substantially cylindrical assembly configured to receive a center conductor 565 of power cable 510 therein. Upon insertion of center conductor 565 therein, crimp connector portion 555 may be crimped onto power center conductor 565 prior to insertion of cable 510 into conductor receiving end 505.

Spade portion 560 may be conductively coupled to crimp connector portion 555 and may extend axially therefrom. As shown in FIG. 5, upon insertion of spade assembly 545 into connector 500, spade portion 560 may project into a space between first T end 515 and bushing well interface T end 520. As shown in FIGS. 6A-6B, spade portion 560 may include a perpendicular bore 570 extending from first T end 515 to bushing well interface T end 520. As described below, once spade assembly 545 is properly seated within connector 500, bore 570 may allow a stud or other element associated with first T end 515 and/or bushing well interface T end 520 to conductively engage spade assembly 545 and/or a device connected to bushing well interface T end 520.

Consistent with implementations described herein, a conductive stud 575 may be inserted into stud receiving portion 529 of bushing well interface T end 520. Configuration of power elbow connector 500 to include bushing well interface T end 520 may facilitate connection of a second reducing type device (not shown) without requiring an intermediate device. Known bushing well interface devices may include a conductive stud enclosed therein. However, incorporation of such an enclosed stud may prevent or substantially impair visual alignment during insertion of conductor spade assembly 545 into power elbow connector 500.

By providing stud 575 initially removed from bushing well interface T end 520, a technician or installer may be provided with visual access to spade portion 560 of conductor spade assembly 545 during assembly of connector 500. FIG. 6A is a top view of power elbow connector 500 in a misaligned configuration. As shown in FIG. 6A, during initial assembly, spade portion 560 may be inserted into connector 500 such that bore 570 in spade portion 560 is not completely aligned (e.g., not concentrically aligned) with stud receiving portion 529 in bushing well interface T end 520. Because bushing well interface T end 520 does not initially include conductive stud 575, the installer may visually identify the misalignment and may fully insert spade portion 560 into connector 500, as shown in FIG. 6B. When fully inserted, bore 570 in spade portion 560 may be concentrically aligned with stud receiving portion 529 in bushing well interface T end 520.

FIG. 7 is a schematic cross-sectional diagram of electrical connector 500 in an assembled configuration. As shown, a deadbreak bushing 705 may be mounted (e.g., welded, etc.) to an electrical switchgear, such as transformer housing 710 (a portion of which is shown in FIG. 7). Following full insertion of spade portion 560 into connector 500 (as visually confirmed through stud receiving portion 529), bushing receiving portion 522 in first T end 515 may be positioned onto bushing 705 such that a stud receiving portion 715 of bushing 705 is aligned with bore 570 in spade portion 560.

Once power elbow connector 500 has been placed on bushing 705, conductive stud 575 may be inserted through stud receiving portion 529, bore 570, and into stud receiving portion 715 of bushing 705. In one implementation, stud receiving portion 715 of bushing 705 may include a female threaded interface for engaging a male threaded exterior surface of conductive stud 575.

Figure 8:
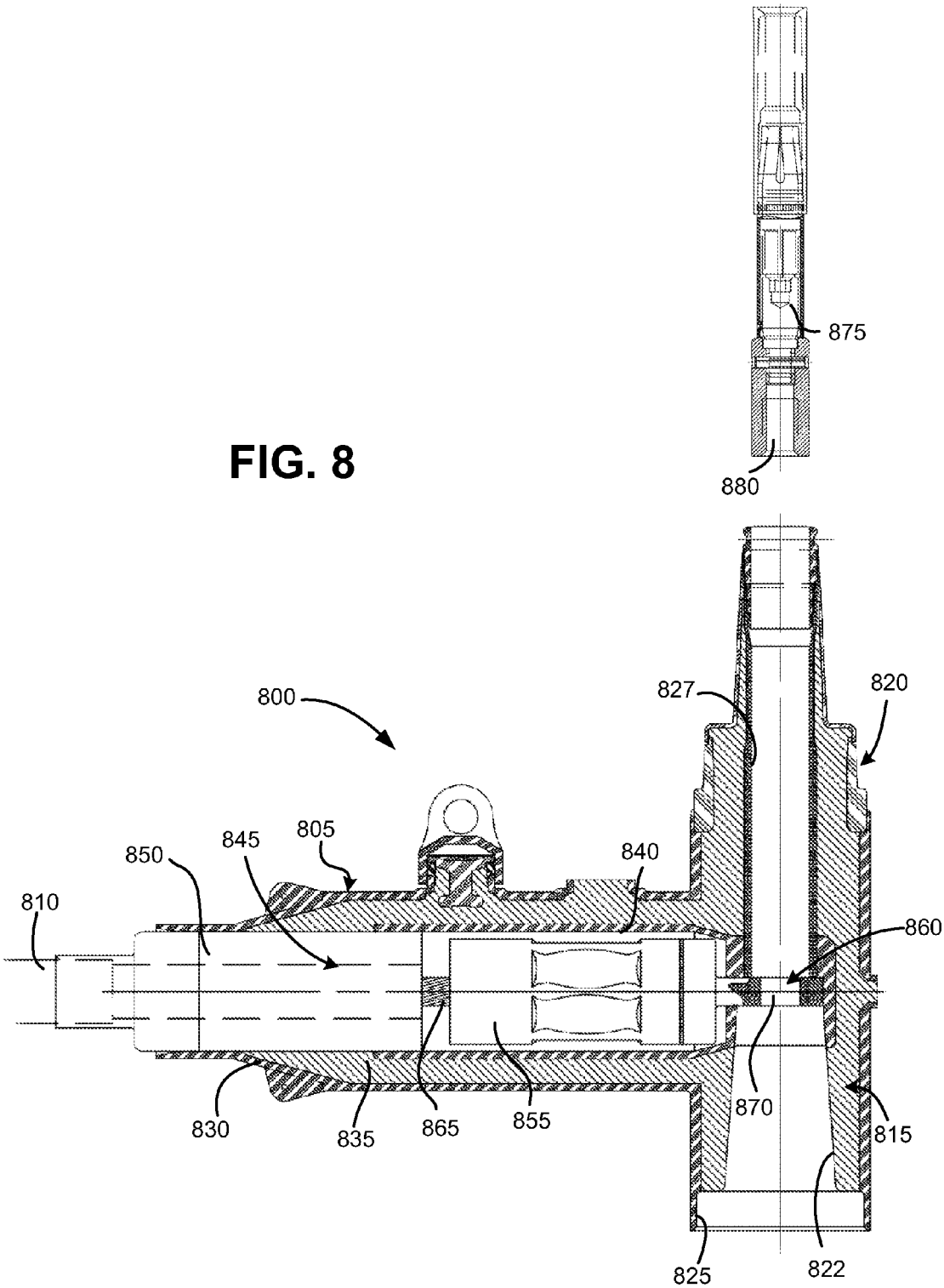
FIG. 8 is a schematic cross-sectional diagram illustrating an electrical connector consistent with still another implementation described herein.

FIG. 8 is a schematic cross-sectional diagram illustrating another implementation of combined power cable elbow connector 800 in an unassembled configuration consistent with implementations described herein. Similar to combined power cable elbow connector 100 shown in FIGS. 1-4, combined power cable elbow connector 800 may include a conductor receiving end 805 for receiving a power cable 810 therein, a first T end 815 that includes an opening for receiving a deadbreak transformer bushing (transformer bushing 1005 in FIG. 10) or other high or medium voltage terminal, an insulating plug, etc., and a loadbreak reducing T end 820 that includes an opening for receiving a second elbow or other device (e.g., a 200 Amp loadbreak device).

As shown in FIG. 8, first T end 815 may include a bushing receiving portion 822 and a flange or elbow cuff 825. Bushing receiving portion 822 may include substantially conical sidewalls configured to receive mating sidewalls of an attached bushing or other device. Flange or elbow cuff 825 may surround the open receiving end of first T end 815 to provide a seating surface for sealingly receiving an attached bushing or other device (see FIG. 10).

Consistent with implementations described herein, loadbreak reducing T end 820 may include a contact receiving portion 827. As described in detail below, contact receiving portion 827 may include a substantially cylindrical bore for receiving a contact assembly therein. As shown in FIG. 8, contact receiving portion 827 may be axially aligned with bushing receiving portion 822.

Figure 9A:
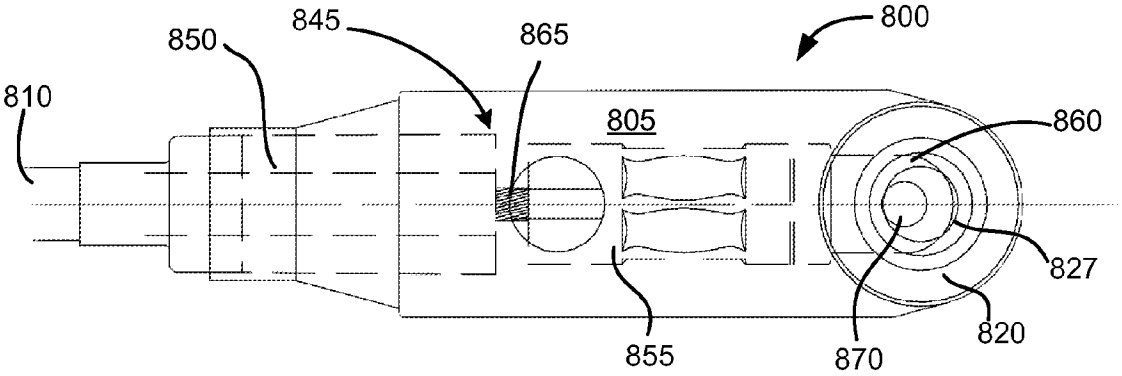
FIG. 9A is top view of the electrical connector of FIG. 8 in a misaligned configuration.
Figure 9B:
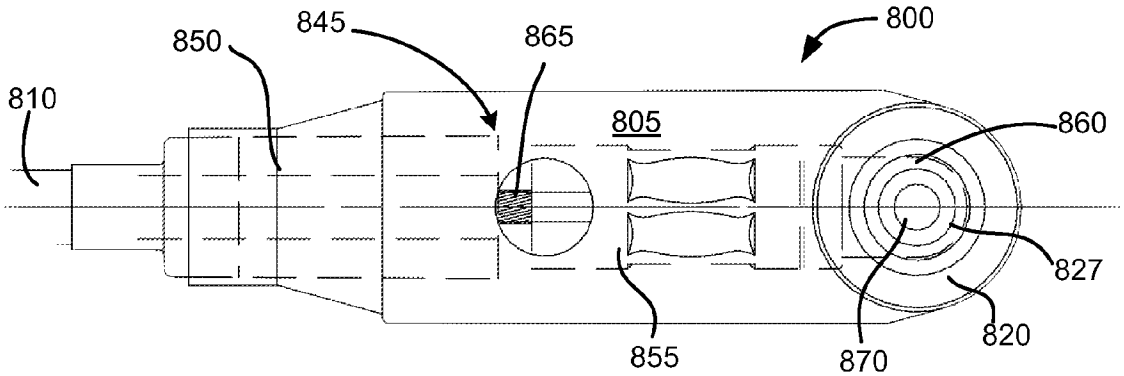
FIG. 9B is top view of the electrical connector of FIG. 8 in an aligned configuration.
Figure 10:
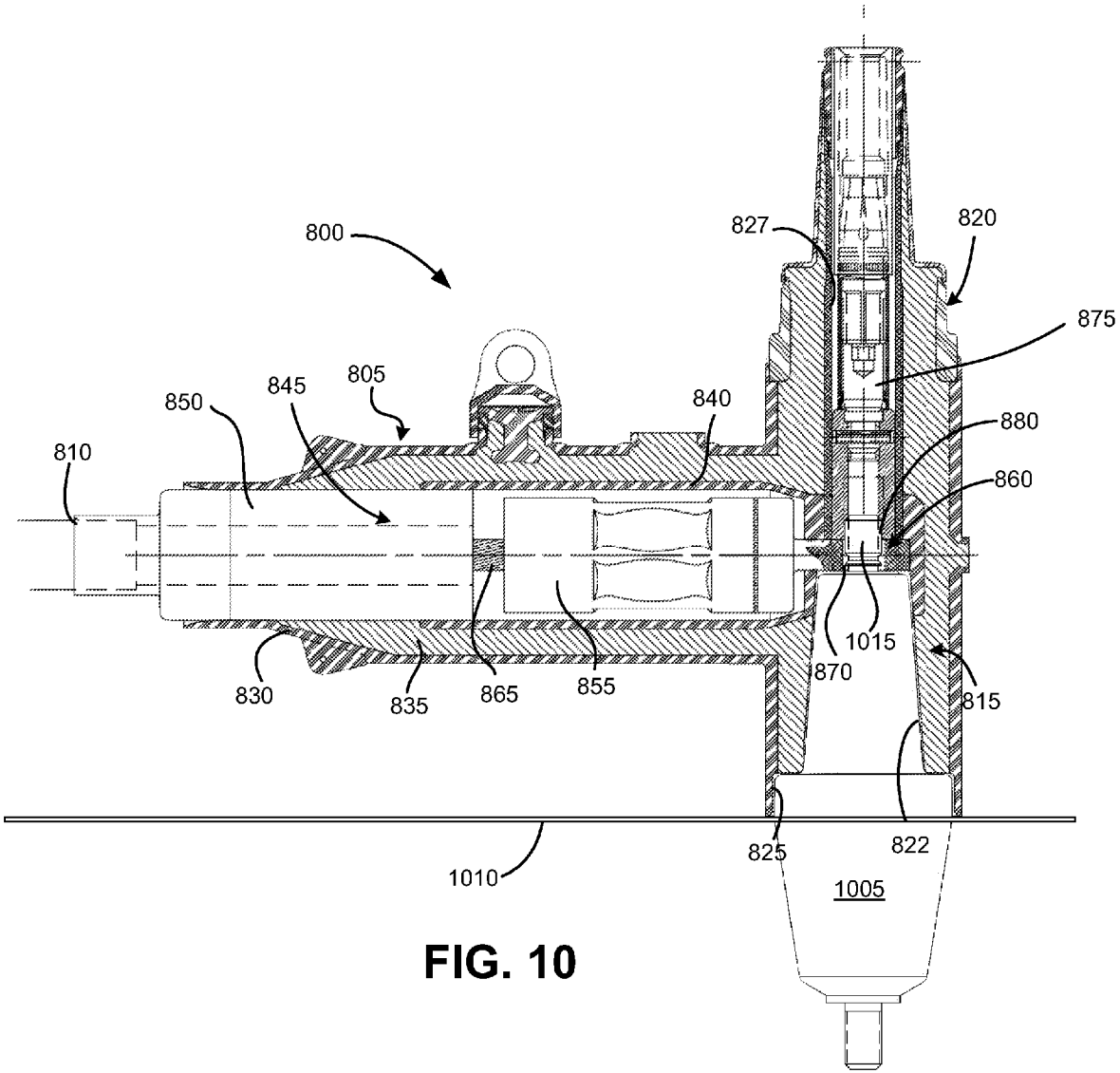
FIG. 10 is a schematic cross-sectional diagram of the electrical connector of FIG. 8 in an assembled configuration.

Conductor receiving end 805 may extend substantially axially from connector 800 and may include a bore extending therethrough. First T end 815 and loadbreak reducing T end 820 may project substantially perpendicularly from conductor receiving end 805, as illustrated in FIGS. 8-10.

In some implementations, combined power cable elbow connector 800 may include a semi-conductive outer shield 830 formed from, for example, a semi-conductive variant of a peroxide-cured synthetic rubber, such as EPDM. Within shield 830, combined power cable elbow connector 800 may include an insulative inner housing 835, typically molded from an insulative rubber or epoxy material. Within insulative inner housing 835, combined power cable elbow connector 800 may include a conductive or semi-conductive insert 840 that surrounds the connection portion of power cable 810.

Conductor receiving end 805 of combined power cable elbow connector 800 may be configured to receive power cable 810 therein. As described below with respect to FIGS. 9A, 9B, and 10, a forward end of power cable 810 may be prepared by connecting power cable 810 to a conductor spade assembly 845. As illustrated in FIGS. 8-10, conductor spade assembly 845 may include a modular configuration. More specifically, conductor spade assembly 845 may include a rearward sealing portion 850, a crimp connector portion 855, and a spade portion 860.

Rearward sealing portion 850 may include an insulative material surrounding a portion of power cable 810 about an opening of conductor receiving end 805. When conductor spade assembly 845 is positioned within connector 800, rearward sealing portion 850 may seal an opening of conductor receiving end 805 about power cable 810.

Crimp connector portion 855 may include a substantially cylindrical assembly configured to receive a center conductor 865 of power cable 810 therein. Upon insertion of center conductor 865 therein, crimp connector portion 855 may be crimped onto power center conductor 865 prior to insertion of cable 810 into conductor receiving end 805.

Spade portion 860 may be conductively coupled to crimp connector portion 855 and may extend axially therefrom. As shown in FIG. 8, upon insertion of spade assembly 845 into connector 800, spade portion 860 may project into a space between first T end 815 and loadbreak reducing T end 820. As shown in FIGS. 8, 9A and 9B, spade portion 860 may include a perpendicular bore 870 extending from first T end 815 to loadbreak reducing T end 820. As described below, once spade assembly 845 is properly seated within connector 800, bore 870 may allow a stud or other element associated with first T end 815 to conductively engage spade assembly 845 and/or a device connected to loadbreak reducing T end 820.

Consistent with implementations described herein, connector 800 may include a contact assembly 875 for insertion within contact receiving portion 827 of loadbreak reducing T end 820. Configuration of power elbow connector 800 to include loadbreak reducing T end 820 may facilitate connection of a loadbreak device to connector 800 via contact assembly 875 without requiring an intermediate reducing plug. Known loadbreak reducing plugs may include conductive contact assemblies enclosed therein. However, incorporation of such an enclosed contact assembly into loadbreak reducing T end 820 may prevent or substantially impair visual alignment during insertion of conductor spade assembly 845 into power elbow connector 800.

By providing contact assembly 875 initially removed from loadbreak reducing T end 820, a technician or installer may be provided with visual access to spade portion 860 of conductor spade assembly 845 during assembly of connector 800. FIG. 9A is a top view of power elbow connector 800 in a misaligned configuration. As shown in FIG. 9A, during initial assembly, spade portion 860 may be inserted into connector 800 such that bore 870 in spade portion 860 is not completely aligned (e.g., not concentrically aligned) with contact receiving portion 827 in loadbreak reducing T end 820. Because loadbreak reducing T end 820 does not initially include contact assembly 875, the installer may visually identify the misalignment and may fully insert spade portion 860 into connector 800, as shown in FIG. 9B. When fully inserted, bore 870 in spade portion 860 may be concentrically aligned with contact receiving portion 827 in loadbreak reducing T end 820.

FIG. 10 is a schematic cross-sectional diagram of electrical connector 800 in an assembled configuration. As shown, a deadbreak bushing 1005 may be mounted (e.g., welded, etc.) to an electrical switchgear, such as transformer housing 1010 (a portion of which is shown in FIG. 10). Following full insertion of spade portion 860 into connector 800 (as visually confirmed through contact receiving portion 827), bushing receiving portion 822 in first T end 815 may be positioned onto bushing 1005 such that a stud portion 1015 of bushing 1005 is received within bore 870 in spade portion 860.

Once power elbow connector 800 has been placed on bushing 1005 (with stud 1015 extending through bore 870), contact assembly 875 may be inserted into contact receiving portion 827 of loadbreak reducing T end 820. In one implementation, contact assembly 875 may include a stud receiving portion 880 for conductively engaging stud 1015 in bushing 1005. For example, an inside diameter of stud receiving portion 880 may be sized slightly smaller than an outside diameter of stud 1015. In other implementations (not shown), stud 1015 and stud receiving portion 880 may include correspondingly threaded surfaces for engaging one another and retaining connector 800 to bushing 1005.

By providing an effective and easy to use mechanism for visually confirming alignment of a conductor spade assembly within a combined power cable elbow, installing personnel may be able to more easily identify alignment issues, thereby preventing damage to equipment caused by misalignment.

The foregoing description of exemplary implementations provides illustration and description, but is not intended to be exhaustive or to limit the embodiments described herein to the precise form disclosed. Modifications and variations are possible in light of the above teachings or may be acquired from practice of the embodiments. For example, implementations may also be used for other devices, such as other high voltage switchgear equipment, such as any 15 kV, 25 kV, or 35 kV equipment.

For example, various features have been mainly described above with respect to elbow power connectors. In other implementations, other medium/high voltage power components may be configured to include the visible open port configuration described above.

Although the invention has been described in detail above, it is expressly understood that it will be apparent to persons skilled in the relevant art that the invention may be modified without departing from the spirit of the invention. Various changes of form, design, or arrangement may be made to the invention without departing from the spirit and scope of the invention. Therefore, the above-mentioned description is to be considered exemplary, rather than limiting, and the true scope of the invention is that defined in the following claims.

No element, act, or instruction used in the description of the present application should be construed as critical or essential to the invention unless explicitly described as such. Also, as used herein, the article "a" is intended to include one or more items. Further, the phrase "based on" is intended to mean "based, at least in part, on" unless explicitly stated otherwise.

What is claimed is:

1. An electrical connector assembly, comprising:

a connector body having a conductor receiving end, a bushing receiving end, and a reducing end, wherein the bushing receiving end and the reducing end are formed substantially perpendicularly to an axial direction of the conductor receiving end, and wherein the reducing end is configured to receive another electrical connector directly thereon, wherein the connector body includes a first axial bore that communicates with each of a second axial bore and a third axial bore in the reducing end and bushing receiving end, respectively;

a conductor spade assembly received in the first axial bore of the connector body, wherein the conductor spade assembly includes a spade portion extending between the second axial bore of the reducing end and the third axial bore of the bushing receiving end; and a removable contact received within the second axial bore of the reducing end to conductively engage the spade portion of the conductor spade assembly, wherein the removable contact does not comprise a reducing plug.

2. The electrical connector of claim 1, wherein the second axial bore of the reducing end is sized to permit viewing of the spade portion when the conductor spade assembly is inserted into the connector body and before insertion of the removable contact.

3. The electrical connector of claim 1, wherein the spade portion includes a bore therethrough configured to align with the second and third axial bores when the conductor spade assembly is fully inserted into the connector body, and wherein concentric alignment of the bore in the spade portion with the second axial bore and the third axial bore may be ascertained when the removable contact is initially removed from the second axial bore of the reducing end.

4. The electrical connector of claim 3, wherein the bushing receiving end is configured to receive a bushing into the third axial bore.

5. The electrical connector of claim 4, wherein the bore in the spade portion is configured to receive a stud projecting from the bushing when the bushing is received in the bushing receiving end and when the conductor spade assembly is fully inserted into the connector body.

6. The electrical connector of claim 5, wherein the removable contact is configured to conductively engage the stud projecting from the bushing upon insertion of the removable contact into the second axial bore of the reducing end.

7. The electrical connector of claim 4, wherein the bore in the spade portion is configured to align with a bore in the bushing when the bushing is received in the bushing receiving end and when the conductor spade assembly is fully inserted into the connector body, and wherein the removable contact is configured to be received in the bore in the bushing and the bore in the spade portion.

8. The electrical connector of claim 1, wherein an end of the removable contact includes a cavity having an internal threaded surface for engaging an external threaded surface of a bushing stud projecting through the conductor spade assembly.

9. The electrical connector of claim 1, wherein the reducing end comprises a loadbreak reducing end, or a deadbreak reducing end.

10. The electrical connector assembly of claim 1, wherein the removable contact comprises copper or aluminum.

11. A power cable elbow connector assembly, comprising:

a connector body having a conductor receiving end, a bushing receiving end projecting substantially perpendicularly from the connector body, and a reducing end projecting substantially perpendicularly from the connector body and oriented substantially opposite to the bushing receiving end, wherein the connector body includes a first axial bore that communicates with each of a second axial bore and a third axial bore in the bushing receiving and reducing ends, respectively, and wherein the bushing receiving end is configured to receive a switchgear bushing therein;

a conductor spade assembly configured to conductively engage a power cable, wherein the conductor spade assembly is configured to be received in the first axial bore such that a spade portion of the conductor spade assembly extends between the second axial bore and the third axial bore; and a removable contact received within the second axial bore of the reducing end to conductively engage the spade portion of the conductor spade assembly and the switchgear bushing.

12. The power cable elbow connector assembly of claim 11, wherein the second axial bore is axially aligned with the third axial bore.

13. The power cable elbow connector assembly of claim 11, wherein the spade portion includes a bore therethrough, and wherein the second axial bore in the reducing end is configured to allow viewing of the bore in the spade portion before insertion of the removable contact.

14. The power cable elbow connector of claim 13, wherein the bore in the spade portion is configured to receive a stud projecting from the switchgear bushing when the switchgear bushing is received in the bushing receiving end and when the conductor spade assembly is fully inserted into the connector body.

15. The power cable elbow connector of claim 14, wherein the removable contact is configured to conductively engage the stud projecting from the bushing.

16. A method, comprising:

inserting a conductor spade assembly in a first axial bore in a power cable connector body that includes a conductor receiving end, a bushing interface end, and a reducing end, wherein the first axial bore is provided in the conductor receiving end, wherein the bushing interface end and the reducing end are formed substantially perpendicularly to an axial direction of the conductor receiving end, wherein the first axial bore communicates with a second axial bore and a third axial bore provided in the bushing interface end and reducing end, respectively, and wherein the conductor spade assembly includes a spade portion extending from the first axial bore between the second axial bore and the third axial bore, the spade portion including a hole therethrough;

visually confirming through the second axial bore that the hole is concentrically aligned with the second axial bore and the third axial bore;

receiving a switchgear bushing into the bushing interface end such that a stud projects from the switchgear bushing through the hole in the spade portion; and inserting a removable contact within the second axial bore to conductively engage the stud and the spade portion of the conductor spade assembly.

17. The method of claim 16, wherein the reducing end is configured to receive a bushing interface end of a second power cable elbow connector.

18. The method of claim 16, wherein inserting the removable contact comprises threading the removable contact onto the stud.

* * * * *